US007021236B1

(12) United States Patent
Czipri

(10) Patent No.: US 7,021,236 B1
(45) Date of Patent: Apr. 4, 2006

(54) BOAT LIGHT

(75) Inventor: John Czipri, Palm Harbor, FL (US)

(73) Assignee: R & D Shed LLC, Palm Harbor, FL (US)

( * ) Notice: Subject to any disclaimer, the term of this patent is extended or adjusted under 35 U.S.C. 154(b) by 0 days.

(21) Appl. No.: 11/178,768

(22) Filed: Jul. 11, 2005

(51) Int. Cl.
*B63B 17/00* (2006.01)

(52) U.S. Cl. ..... 114/364; 362/477; 362/269

(58) Field of Classification Search ..... 114/343, 114/218, 364; 362/527, 365, 269, 477
See application file for complete search history.

(56) References Cited

U.S. PATENT DOCUMENTS 2,421,680 A * 6/1947 Candlin, Jr. et al. ..... 362/483
4,270,478 A * 6/1981 Kafka et al. ..... 114/218
4,600,978 A * 7/1986 Kimura ..... 362/365
5,216,972 A * 6/1993 Dufrene et al. ..... 362/477
5,268,824 A 12/1993 Czipri
5,803,585 A * 9/1998 Littman et al. ..... 362/147

* cited by examiner

*Primary Examiner*—Ed Swinehart
(74) *Attorney, Agent, or Firm*—McKee, Voorhees & Sease, P.L.C.

(57) ABSTRACT

A pivotal boat light moves between an open use position extending upwardly from the deck of a boat and a closed non-use position retracted below the deck of a boat. The light includes a base plate mounted within a hole in the deck, and a light insert pivotably mounted in the base plate for movement between the open and closed positions. A spring normally biases the light insert to the open position, while a pawl or lock member retains the light insert in the closed position.

27 Claims, 3 Drawing Sheets

BOAT LIGHT

BACKGROUND OF THE INVENTION

Boat lights often are mounted on the bow of the boat or on the hull or cabin of the boat so as to extend upwardly for visibility and projection of the light. These lights include conventional red and green navigation lights, as well as white lights. The raised position of such conventionally mounted lights presents a hazard, since the light projects upwardly or outwardly from the boat deck, whether or not the light is in use. Such raised lights may be tripped over, bumped into, or entangled by a rope. If mounted on the outside hull of the boat, such outwardly projecting lights may strike a dock, piling, or other structure and cause damage to the light or to the boat.

More recently, some boat lights have been pivotally mounted to the deck so as to be moveable between a flush position with the light recessed into the boat when not in use, and a raised or extending position above the deck surface when the light is in use. For example, see Applicant's U.S. Pat. No. 5,268,824 which shows a pivotally mounted light which can be manually moved between the flush lower position and the raised upper position. In the '824 patent, a pair of resilient fingers releasably engage a post on the pivotal light member to retain the light in either the raised or lowered positions. However, such movement of the light requires strength in the operator's fingers to overcome the tight, frictional engagement of the retention fingers, which is difficult for some people.

Accordingly, a primary objective of the present invention is a provision of an improved boat light which is quickly and easily moveable between a raised and lowered position.

Another objective of the present invention is the provision of an improved boat light which is spring biased toward a raised position.

Still another objective of the present invention is the provision of a spring biased boat light which is moveable between raised and lowered positions, and retained in the lowered position by a sliding lock member.

Yet another objective of the present invention is the provision of an improved boat light which is releasably retained in the lowered position by a spring biased pawl.

Another objective of the present invention is the provision of an improved boat light which is economical to manufacture and durable in use.

These and other objectives will become apparent from the following description of the invention.

SUMMARY OF THE INVENTION

The boat light assembly of the present invention includes a base plate adapted to be mounted in a hole in a boat bow, hull or cabin. The light assembly includes a base plate with an upper flange which overlies the hole and a lower portion extending into the hole. A spring-biased light insert is pivotally mounted in the base plate for movement between a retracted lower position and an extended upper position. A spring is provided on the axle of the light insert so as to normally bias the light insert to the raised upper position. A slidable lock member or pawl is provided on the light insert for movement between a locked position to hold the light insert in the lower position, and an unlocked position to allow the light to pivot to the upper position. The lock member is normally urged to the locked position by a spring. A cup extends downwardly from to the base plate so as to reside below the boat deck and surround the light insert when the light insert is in the lowered position.

DETAILED DESCRIPTION OF THE PREFERRED EMBODIMENT

The present invention is directed towards a boat light 10 which is pivotal between a raised or extended upper position when in use and a retracted lower position when not in use. The light 10 is adapted to be mounted in the bow, hull, or cabin of a boat so as to be substantially flush with the boat deck 12 when in the lower position and project upwardly from the boat deck 12 when in the upper position. The light 10 is adapted to be installed through a hole in the boat deck 12.

Figure 6:
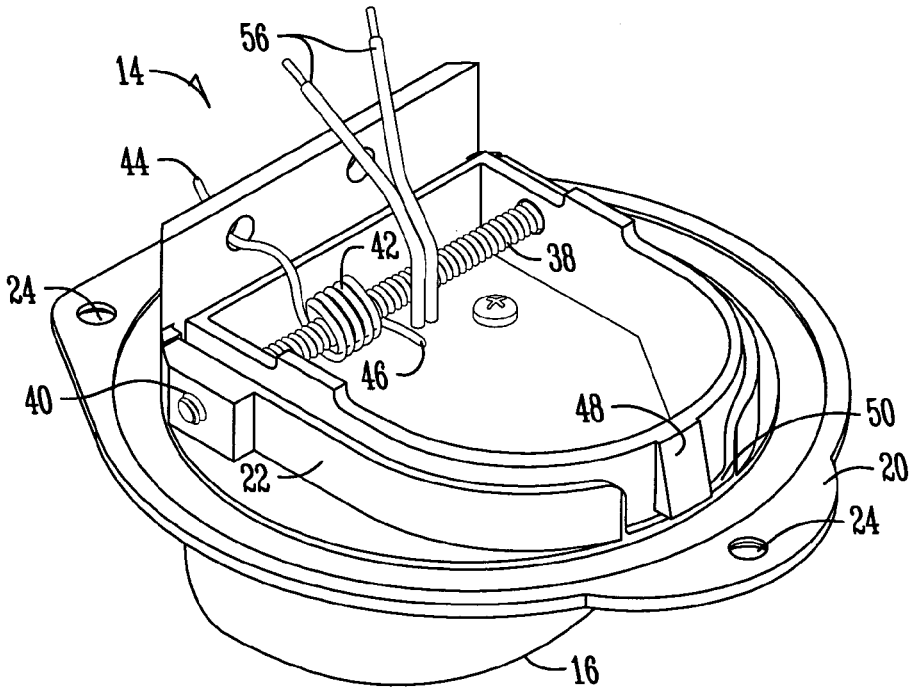
FIG. 6 is an exploded bottom perspective view of the base plate and light insert.

The light 10 generally comprises three components, including a base plate or mounting plate 14, a light insert 16, and a cup 18. As best seen in FIG. 6, the base plate 14 includes an upper flange 20 which is adapted to overlay the hole in the boat deck 12, and a downwardly extending frame 22. The base plate 14 is preferably made of corrosion and weather resistant material, with at least the upper surface of the flange 20 being chrome plated. Mounting holes 24 are provided in the flange 20 so that the base plate 14 can be secured to the deck 12 using any convenient fastener, such as screws or bolts.

The light insert 16 includes a housing 26 with a face plate 28 and a curved body 30. The housing 26 is hollow and open at the bottom 32. A light bulb assembly 34 is mounted within the housing 26. The curved body 30 of the housing 26 includes a pair of lenses 36. The lenses 36 may be clear or colored. For example, if the light 10 is mounted on the bow of the boat, the starboard lens should be green and the port lens should be red. The lenses 36 may be any desired shape.

Figure 3:
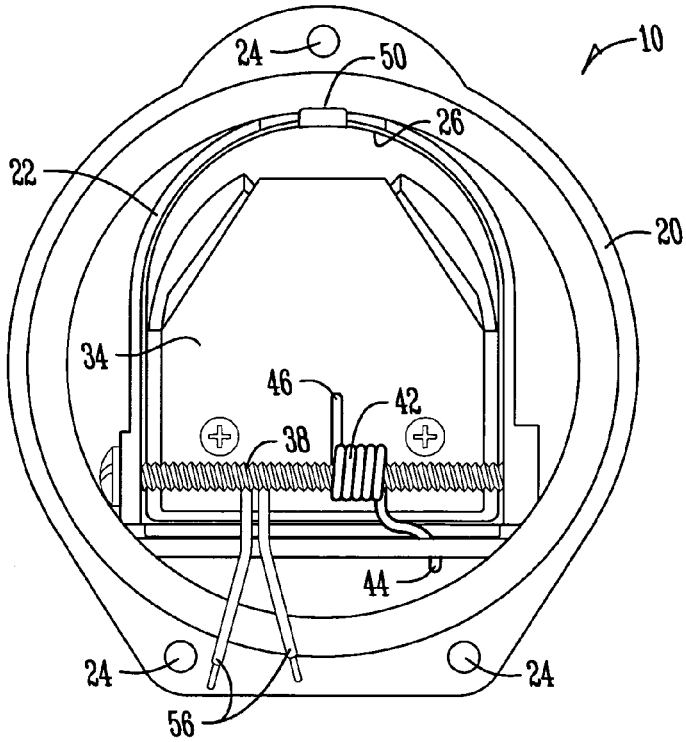
FIG. 3 is a view taken along lines 3—3 of FIG. 1.
Figure 4:
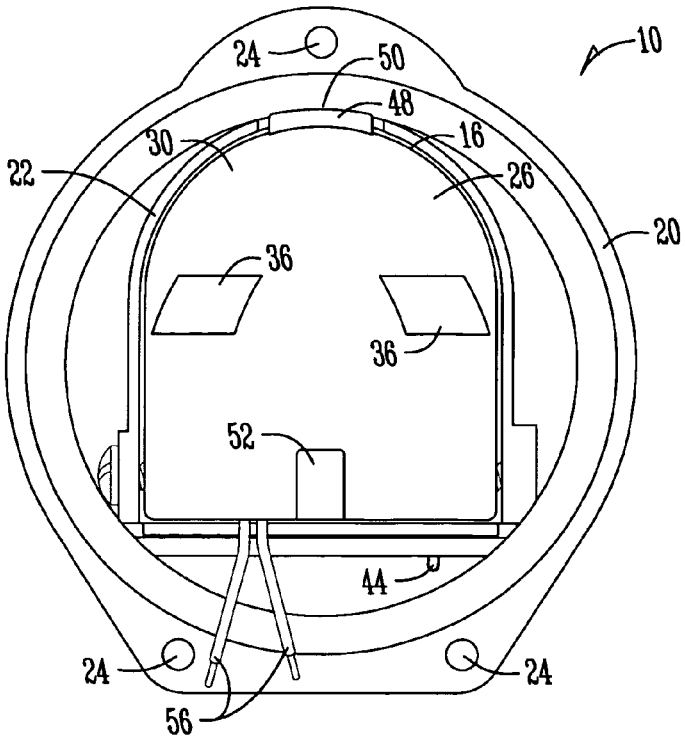
FIG. 4 is a view taken along lines 4—4 of FIG. 2.

The light insert 16 is pivotally mounted to the base plate 14 for movement between a raised upper position when in use and a retracted lower position when not in use. An axle 38 extends through opposite side of the light insert 16 and opposite sides of the base plate frame 22, as best seen in FIG. 3. The axle 38 may be secured in position in any convenient means. For example, one of the holes 40 in the frame 22 may be threaded, with the end of the axle 38 being threaded for mating receipt in the threaded hole 40. Alternatively, the axle 25 may be a bolt secured with a nut, or a shaft secured with a pin or lock ring.

A spring 42 is mounted on the axle 38, and has a first end 44 engaging the frame 22 of the base plate 14, and a second end 46 engaging the light bulb support structure 34. The spring 42 normally biases the light insert 16 to the raised or extended position for use.

Figure 5:
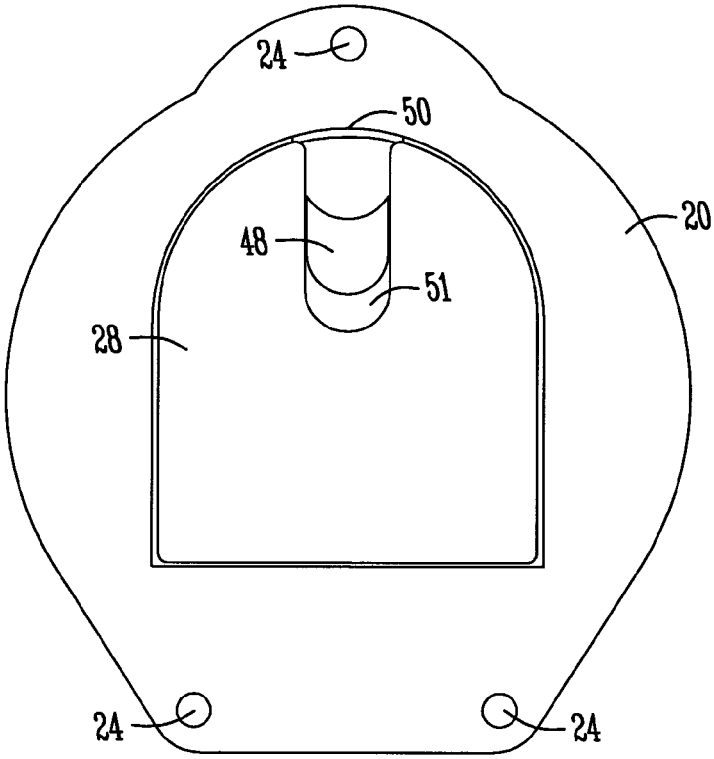
FIG. 5 is a top plan view of the light taken along lines 5—5 of FIG. 2.

The insert housing 26 further includes a spring loaded pawl or lock member 48 which is adapted to engage a lip 50 on the base plate flange 20 so as to retain the insert 16 in the retracted lower position. The lock member is slidably mounted in a track 51 in the housing 26, with a spring (not shown) biasing the lock member 48 to the locked position. The lock member 48 can be slid inwardly along the track 51 from the locked position shown in FIG. 5 to the unlocked position by a person's finger, so as to disengage the lip 50 and allow the insert 16 to pivot upwardly from the retracted or closed position to the raised open position. Since the lock member 48 is biased to the locked position, when the insert 16 is pushed to the closed or lowered position, the lock member 48 will automatically engage the lip 50 to retain the insert 16 in the lower position. The light insert 16 also includes a stop member 52 which engages the lip 50 to limit the pivotal movement of the light insert 16 to approximately 90° from the closed to the open position.

Figure 1:
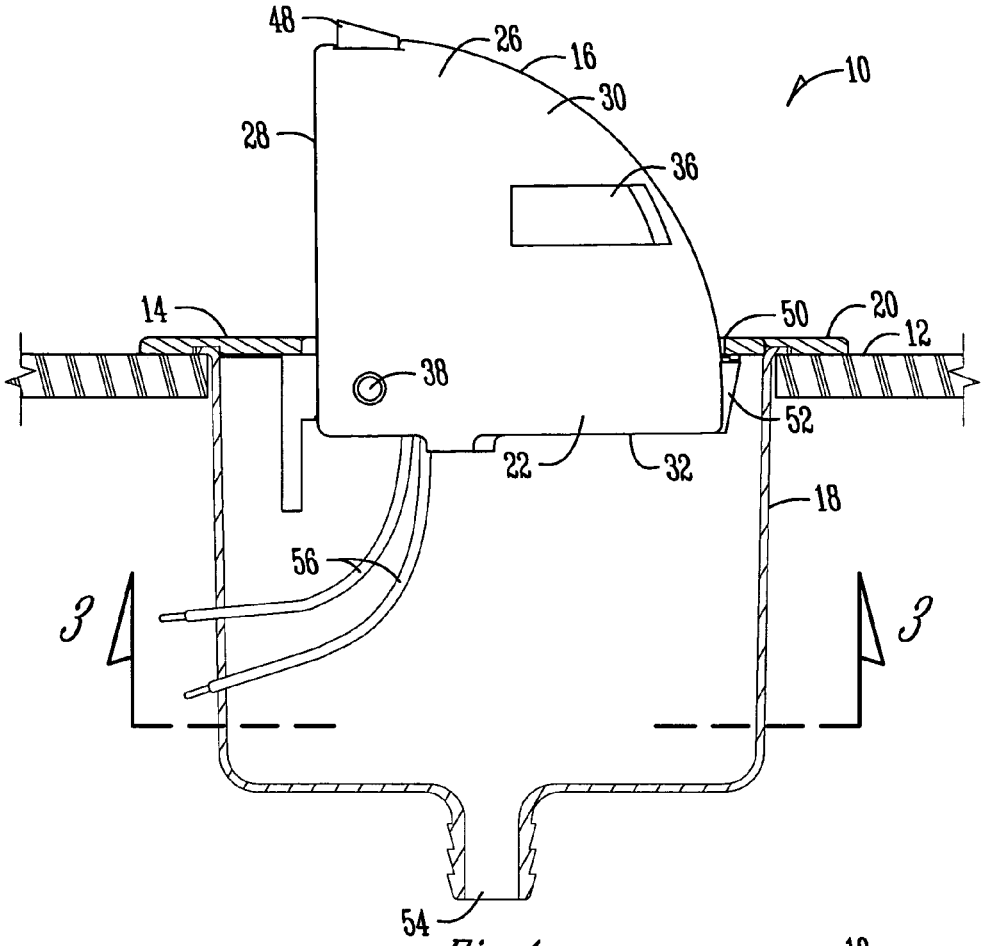
FIG. 1 is a sectional view showing the improved boat light of the present invention in the raised upper position.
Figure 2:
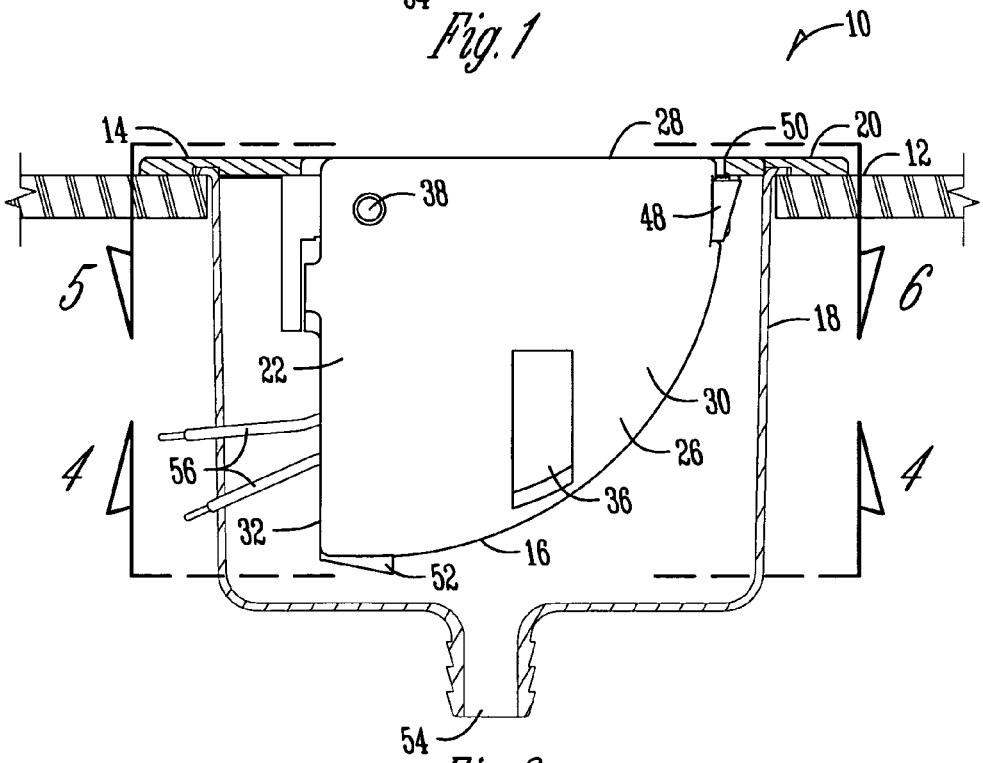
FIG. 2 is a sectional view showing the improved boat light of the present invention in the retracted lower position.

The cup 18 engages the base plate 14 and is retained by the perimeter of the boat deck hole, as seen in FIGS. 1 and 2. Alternatively, the cup 18 can be attached to the base plate 14 with adhesive, welding, or any other convenient attachment means. The cup surrounds the light insert 16 when the insert is moved to the lowered position. The cup 18 includes a drain opening 54 for drainage of water which may pass between the base plate 14 and the insert 16. A hose (not shown) extends from the drain opening 54 to the bilge of the boat. Cup 18 also includes one or more holes through which electrical wires 56 extend for connecting the light bulb to a power source, such as a boat battery.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A boat light, comprising:

a base plate adapted to mount in a hole in a boat, and having an upper flange overlying the hole and a lower portion extending into the hole;

a light insert pivotally mounted in the base plate for movement between a closed position and an open position;

a spring to bias the light insert to the open position;

a pawl to selectively retain the light insert in the closed position against the bias of the spring;

an axle extending through the base plate and to which the light insert is mounted; and the spring being mounted on the axle.

2. The boat light of claim 1 wherein the light insert extends above the base plate flange when in the open position and extends below the base plate flange when in the closed position.

3. The boat light of claim 1 wherein the pawl is moveable between a lock position and an unlock position.

4. The boat light of claim 3 wherein the pawl is biased to the lock position.

5. The boat light of claim 3 further comprising a spring to urge the pawl to the lock position.

6. The boat light of claim 1 further comprising a cup mounted to the base plate so as to reside below the boat hole.

7. The boat light of claim 1 wherein the flange of the base plate includes a lip for retentive engagement by the pawl.

8. The boat light of claim 1 wherein the base plate includes an inner frame surrounding the light insert.

9. A boat light, comprising:

a base plate adapted to mount in a hole in a boat, and having an upper flange overlying the hole and a lower portion extending into the hole;

a spring biased light insert mounted in the base plate for movement between raised and lowered positions;

a slidable lock member on the light insert adapted to slide between a locked position and an unlocked position to allow the light insert to move to the raised position; and the flange of the base plate including a lip for retentive engagement by the lock member.

10. The boat light of claim 9 wherein the light insert is positioned substantially above the base plate flange in the raised position and substantially below the base plate flange in the lowered position.

11. The boat light of claim 9 wherein the lock member is normally urged to the locked position.

12. The boat light of claim 9 further comprising a spring to bias the lock member to the locked position.

13. The boat light of claim 9 further comprising an axle extending through the base plate and to which the light insert is mounted.

14. The boat light of claim 13 further comprising a spring on the axle to bias the light insert to the raised position.

15. The boat light of claim 9 further comprising a cup mounted to the base plate so as to reside below the boat hole.

16. The boat light of claim 9 wherein the base plate includes an inner frame surrounding the light insert.

17. The boat light of claim 9 wherein the light insert pivots substantially 90° between the raised and lowered positions.

18. A boat light, comprising:

a base plate adapted to mount in a hole in a boat, and having an upper flange overlying the hole and a lower portion extending into the hole;

a light insert pivotally mounted in the base plate for movement between a closed position and an open position;

a spring to bias the light insert to the open position;

a pawl to selectively retain the light insert in the closed position against the bias of the spring; and the flange of the base plate includes a lip for retentive engagement by the pawl.

19. The boat light of claim 18 wherein the light insert extends above the base plate flange when in the open position and extends below the base plate flange when in the closed position.

20. The boat light of claim 18 wherein the pawl is moveable between a lock position and an unlock position.

21. The boat light of claim 18 further comprising an axle extending through the base plate and to which the light insert is mounted, and the spring is mounted on the axle.

22. The boat light of claim 18 further comprising a cup mounted to the base plate so as to reside below the boat hole.

23. A boat light, comprising:

a base plate adapted to mount in a hole in a boat, and having an upper flange overlying the hole and a lower portion extending into the hole;

a light insert pivotally mounted in the base plate for movement between a closed position and an open position;

a spring to bias the light insert to the open position;

a pawl on the light insert to selectively retain the light insert in the closed position against the bias of the spring.

24. The boat light of claim 23 wherein the light insert extends above the base plate flange when in the open position and extends below the base plate flange when in the closed position.

25. The boat light of claim 23 wherein the pawl is moveable between a lock position and an unlock position.

26. The boat light of claim 23 further comprising an axle extending through the base plate and to which the light insert is mounted, and the spring is mounted on the axle.

27. The boat light of claim 23 further comprising a cup mounted to the base plate so as to reside below the boat hole.

* * * * *